US005458170A

United States Patent [19]

Ferguson

[11] Patent Number: 5,458,170

[45] Date of Patent: Oct. 17, 1995

[54] FUEL DISPENSING DEVICE EQUIPPED WITH A SOUND SYSTEM

[76] Inventor: James D. Ferguson, 405 S. Arnold, Mt. Pleasant, Mich. 48858

[21] Appl. No.: 262,422

[22] Filed: Jun. 20, 1994

[51] Int. Cl.[6] ..... B65B 1/04; B65B 3/00

[52] U.S. Cl. ..... 141/392; 141/98; 369/20; 364/510

[58] Field of Search ..... 141/98, 392; 369/20, 369/22, 72, 73; 340/603, 606; 364/510

[56] References Cited

U.S. PATENT DOCUMENTS

| | | | |
|---|---|---|---|
| 3,666,273 | 5/1972 | Kantola | 369/70 X |
| 4,303,395 | 12/1981 | Bower | 369/20 X |
| 4,736,871 | 4/1988 | Luciani | 222/25 |
| 5,058,637 | 10/1991 | Fell | 141/392 |
| 5,134,716 | 7/1992 | Craig | 369/29 X |
| 5,184,309 | 2/1993 | Simpson | 141/392 X |
| 5,184,655 | 2/1993 | Fell | 141/392 |

FOREIGN PATENT DOCUMENTS

| | | | |
|---|---|---|---|
| 349316 | 1/1990 | European Pat. Off. | 141/392 |
| 3438939 | 5/1986 | Germany | 141/392 |

*Primary Examiner*—Henry J. Recla
*Assistant Examiner*—Steven O. Douglas
*Attorney, Agent, or Firm*—Robert L. McKellar

[57] ABSTRACT

What is disclosed is a novel boot and its use on fuel dispensing devices. The boot contains a recording and playback system for messages or sounds as fuel is being pumped into a vehicle.

7 Claims, 2 Drawing Sheets

FUEL DISPENSING DEVICE EQUIPPED WITH A SOUND SYSTEM

This invention deals with a novel fuel dispensing device which is equipped with a signal recording and playback system which delivers messages and sounds.

The primary but not exclusive function of the device or system is to provide a flexible boot for a fuel dispensing device which contains a recording and playback system to deliver messages or sounds as the fuel is being pumped into a vehicle. The apparatus is generally designed such that it is activated when the nozzle is inverted to pump fuel into the vehicle and is deactivated when the nozzle is replaced in the fuel pump stand.

The most fundamental benefit for this type of device is for advertising various goods and services of local merchants, providing safety messages, and providing good will messages to all customers that fuel their own vehicles.

There are nearly 210,000 service stations in the United States today in which devices of the type described herein could be used.

BACKGROUND OF THE INVENTION

Although the inventor herein is not aware of any device that is similar in appearance or function to the devices of the instant invention, there is at least one patent dealing with a similar part of the instant invention.

That disclosure can be found in Fell U.S. Pat. No. 5,184,655, in which there is described a message display boot for fuel dispensing nozzles. The boot is of the type that is conforming to the outside of a fuel nozzle and it contains a flat message display platform mounted on the top surface of the boot. It has a clear overlay, which is used to protect any printed message placed on the platform from the elements and the fuels being dispensed.

However, the patent to Fell does not include, describe, show, or imply the pre-recorded message device of the instant invention.

THE INVENTION

This invention essentially consists of four embodiments, the novel boot configuration; the novel boot configuration containing the recording and playback system, the combination of the fuel dispensing device and the boot containing the recording and playback system, including an activating switch for the recording and playback system, and a modified embodiment that is useful for adaptation to the fuel hose.

Thus, as noted above, one of the primary but not exclusive functions of the device or system is to provide a flexible boot, for a fuel dispensing device, which boot contains a recording and playback system for messages or sounds as the fuel is being pumped into a vehicle. The apparatus is designed such that it is activated when the fuel dispensing device is inverted to pump fuel into the vehicle and is deactivated when the fuel dispensing device is brought to vertical or near vertical. Thus, the device can be deactivated (switched off) by mere vertical orientation of the fuel dispensing device, however, preferred is a situation in which inverting the fuel dispensing device initiates the deactivation, and then some other method actually deactivates the device after a short message, or a series of short messages have been played.

The invention also includes the combination of the novel boot containing the recordation and playback device with a fuel dispensing device which has an activating-deactivating switch for the recordation and playback device. Preferred for this invention is the placement of the activating-deactivating switch in the housing which holds the playback and recording device, however, the switch can be placed outside of the housing, for example, at the handle of the fuel dispensing nozzle.

Thus, there is provided a flexible boot for a fuel dispensing nozzle, said boot comprising a flexible boot adapted for a close conforming fit over at least a front portion of the fuel dispensing device. The boot has integrally surmounted thereon, a housing for a signal recording and playback system.

In a further embodiment, the housing of the flexible boot contains therein, a signal recording and playback system.

Further, the signal recording and playback system has electrically linked thereto a switch for activating and deactivating said signal recording and playback system. Generally, one convenient location for such a switch is on the handle of the fuel dispensing device, however, as indicated above, the most preferred location is in the housing containing the playback and recording device.

Further, there is contemplated within the scope of this invention the activating or deactivating of the switch by remote control, that is, activating or deactivating the switch from remote location, other than at the fuel dispensing pump.

Still further, there is disclosed herein a method of providing a pre-recorded message during the fueling of a vehicle having a fuel port. The method comprises the utilization of a fuel dispensing pump which is equipped with a fuel dispensing device of this invention, which fuel dispensing device is in a deactivated position at the beginning of the fueling. Most commercial fueling pumps have a port in the pumping stand to accommodate the fuel dispensing device, in which the nozzle of the fuel dispensing device rests when it is not being used. When the nozzle is in the resting, or deactivated position in this port, the device of this invention is deactivated and no sound or message can be heard therefrom. However, removing the fuel dispensing device from the deactivated position and placing the nozzle in the fueling port of the vehicle activates the switch, because the operator necessarily has to invert the nozzle to enter the vehicle fuel port. This activation in turn activates the signal record and playback system into a playback mode whereby a pre-recorded message is rendered audible for the duration of the fueling of the vehicle.

Finally, there is contemplated within the scope of this invention the use of a device which is adaptable to a fuel dispensing hose.

DETAILED DESCRIPTION OF THE DRAWINGS WITH REGARD TO THE INVENTION

Figure 1:
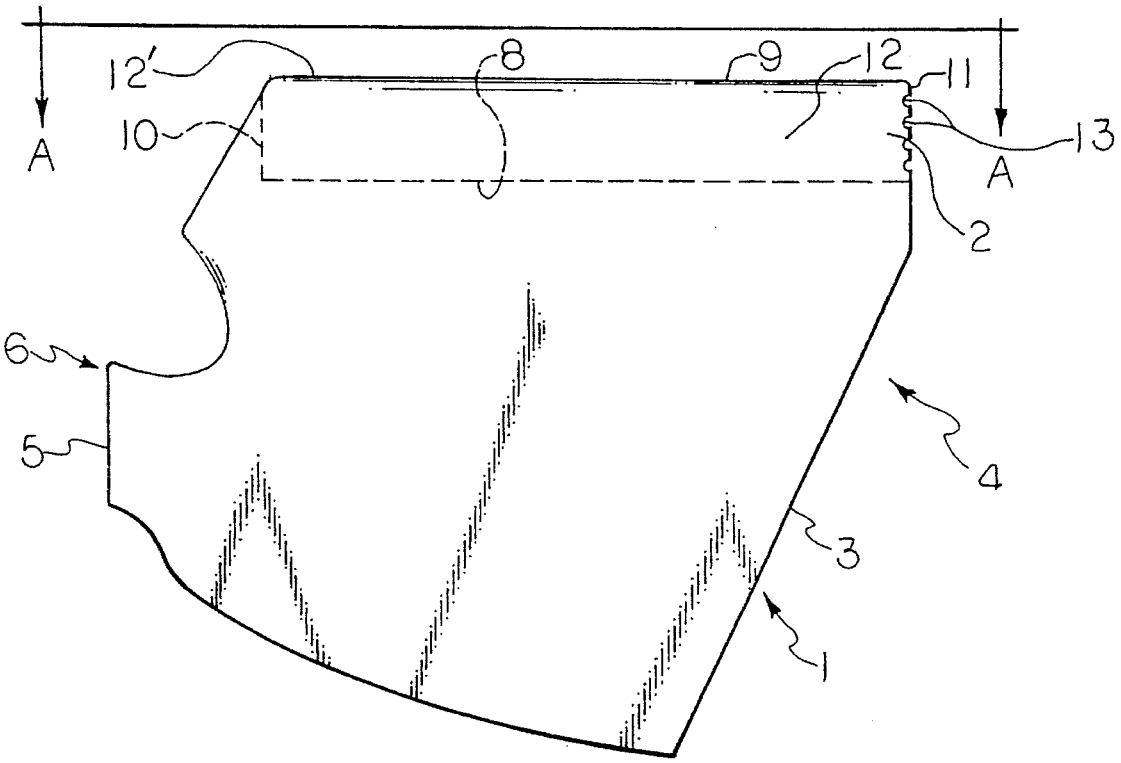
FIG. 1 is a full side view of a flexible boot of this invention.

For purposes of illustrating and disclosing the invention herein to those skilled in the art, and with regard to FIG. 1, there is shown a full side view of the flexible boot 1 of this invention.

The boot is manufactured from flexible, pliable plastic so that it can conform essentially to the outside surface of the nozzle/handle combination of a delivery system for fuel. Such boots are known in commerce today and can be observed on most commercial fuel pump systems, except, the boot of this invention has a unique feature which allows it to have a dual purpose that is not possible with the boots of commerce. Thus, it can be observed from FIG. 1 that the boot of this invention has a housing 2 (shown in phantom in FIG. 1, but in cross-section in FIG. 2), integrally molded into and forming part of the boot 1, which housing 2 is utilized in this invention to house a sound system which will be detailed infra.

The boot 1, in its general configuration has an opening 3 in the back end 4 and a smaller opening 5 in the front end 6, which openings 3 and 5 allow for the positioning of a fuel dispensing device 7 (FIG. 3) therein. The housing 2 is comprised of an open chamber having a bottom 8, top 9, front end 10, back end 11, and sides 12 and 12' (12" not shown, but is identical to side 12 for all intents and purposes).

Back end 11 has open pores 13 through it to allow for the transference of sound from the sound system contained in the housing 2.

Figure 2:
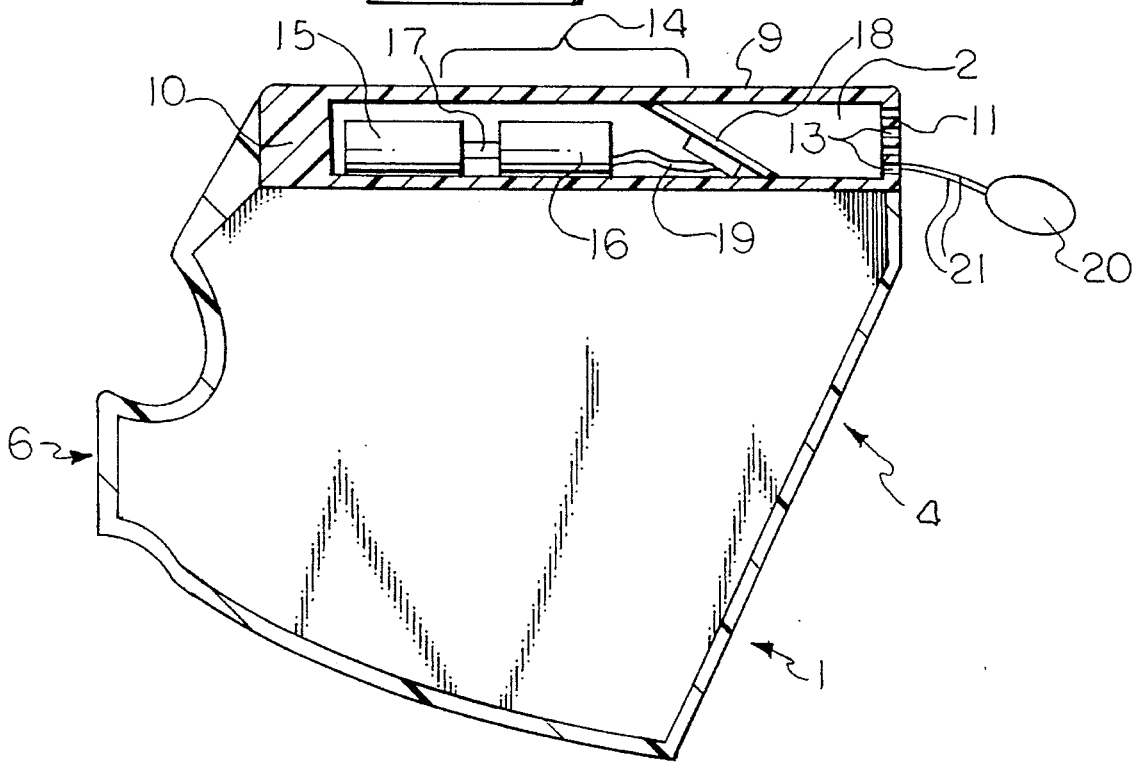
FIG. 2 is a cross-sectional full view of the flexible boot of this invention through the line A—A of FIG. 1.

With regard to FIG. 2, there is shown a full cross sectional view of the boot 1 of FIG. 1, through the lines A—A of FIG. 1. There is also shown front 6, back 4, top 9, front end 10 of the housing, back end 11 of the housing and openings 13. In addition, there is shown a recording and playback system 14, in which there is shown for purposes of illustration, a high density integrated circuit analog signal recording and playback system. This high density integrated circuit analog signal recording and playback system is electrically driven and in the FIG. 2, there is shown an electrical battery pack 15, which is electrically integrated with a recording and playback system 16, by electrical wire pair 17. Further, there is a speaker 18, connected to the system 16 by electrical wire 19 and in addition, there is shown a switch 20, which for all intents and purposes is a mercury switch, which is linked by wires 21 to the recording and playback system 16, all of which constitute the full signal recording and playback system.

Figure 3:
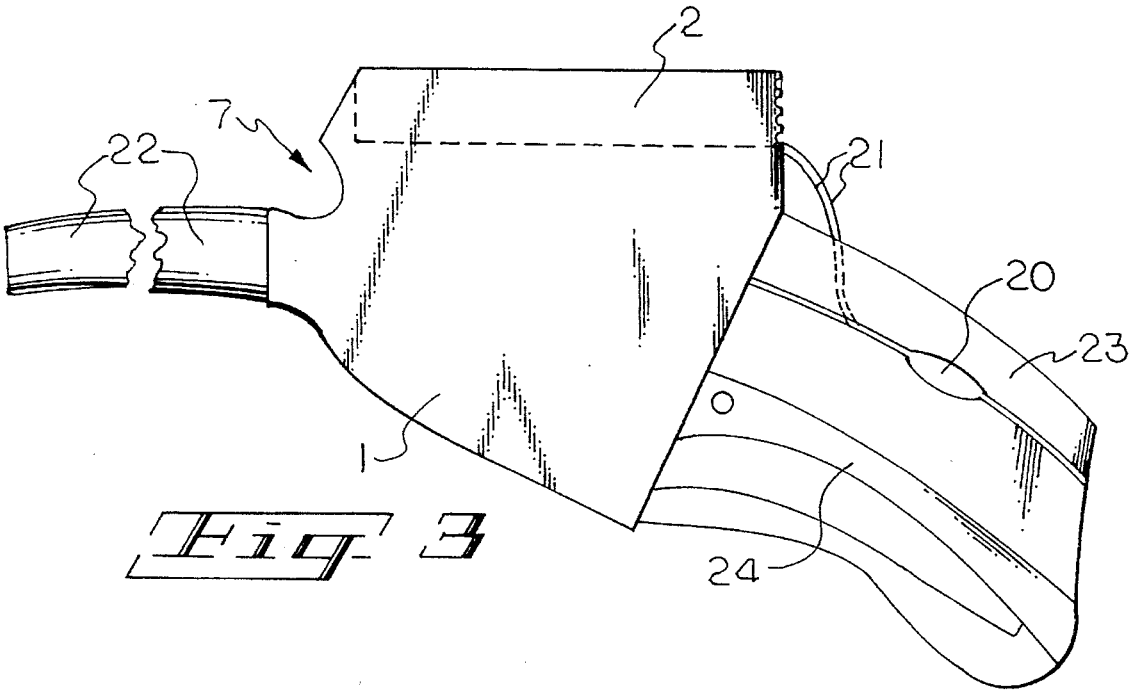
FIG. 3 is a full side view of a nozzle of this invention showing the nozzle covered with a boot.

FIG. 3 shows a full side view of the complete system including the flexible boot 1, containing the housing 2 in phantom, a nozzle 22 for the delivery of fuel to a vehicle. Further, there is shown a handle 23 for the fuel delivery system, an activating device 24 for delivery of the fuel, and the switch 20 for the activation of the recording and playback system 14, which is shown mounted on the underside of the handle 23, along with the wires 21.

Figure 4:
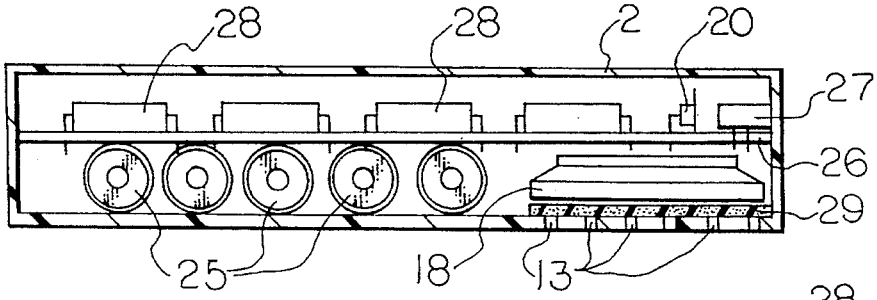
FIG. 4 is a full side view of a housing of the boot of this invention through the line A—A of FIG. 1.

In FIG. 4, there is shown only the housing of the inventive device with the housing 2, containing a series of batteries 25, speaker 18, printed circuit board 26, programming connector 27, record/playback ICs 28, and switch 20, along with the open pores 13 covered with soft mesh 29 to more easily allow the transfer of sound to outside the housing.

Figure 5:
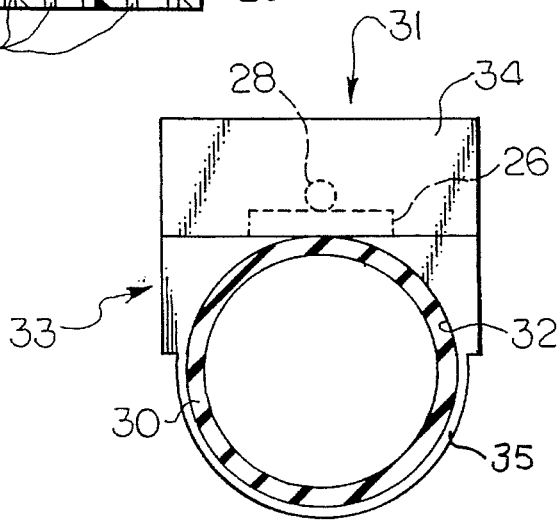
FIG. 5 is a full end cross sectional view of a device of this invention which is useful for adaptation to a fuel dispensing hose.

With regard to FIG. 5, there is shown a cross-sectional end view of a device of this invention which is adaptable to a fuel dispensing hose 30. Also shown is the boot 31, whose lower end 33 is adaptable to the outer surface 32 of the hose 30. Surmounting the lower end 33 of the boot 31 is the housing 34, which holds the recording a playback device shown in phantom as record/playback IC 28, and printed circuit board 26. As with the other boot for the nozzle, the switch for this device in best situated in the housing 34. The boot 31 is held to the hose 30 by a strap 35, or a series of straps 35.

In its most fundamental form, this invention deals with a flexible boot that is capable of having a dual purpose in fuel dispensing when used in conjunction with a fuel delivery device. Further, in its most fundamental form, this invention deals with a battery powered recording and playback device that attaches to a fueling dispenser nozzle such that when activated, a series of sounds are played back.

The signal recording and playback system is configured such that there is employed a device or system to hold or make prerecorded messages that can be quickly downloaded electrically into the signal recordation part of the signal recordation and playback device of the instant invention.

Such messages can be to give the user of the fuel dispensing device a recorded message on the proper use of the device for fueling the vehicle; a message on proper safety precautions for operation of the fuel dispensing device, or more significantly, it can be used to deliver advertising messages to the fuel dispensing device user.

As such, a device or system to hold or make pre-recorded messages is utilized to establish the messages on the inventive device and this could be a series of advertising messages, or a series of safety messages, or a combination of the same. This allows for the convenient changing of the recorded messages at various times. The recordation and playback device of the instant invention has been prerecorded such that it can hold about four to six, 20 second recorded messages for playback use.

In use, one wishing to fuel a vehicle using a dispensing system that is equipped with the invention disclosed herein, merely removes the fuel pump nozzle from the pump, inverts the nozzle for insertion into the fuel port of the vehicle, which activates the switch of the device of the instant invention, and a series of messages are played while the fuel is being dispensed. When the user returns the nozzle to the fuel pump, which results in the nozzle being put into an upright position, then the sound device is inactivated by the operation of the switch. The electronic configuration of the sound system allows for the messages to start from the beginning every time that the fuel pump is used, and thus, all of the messages are given essentially equal time in the playback mode.

That which is claimed is:

1. A flexible boot for a fuel dispensing nozzle, said boot comprising:

(a) a flexible boot adapted for a close conforming fit over at least a front portion of the fuel dispensing nozzle;

(b) said boot having integrally surmounted thereon, a housing;

(c) said housing containing therein, a signal recording and playback system.

2. A fuel dispensing nozzle comprising:

(a) a spout;

(b) a handle for the spout;

(c) a flexible boot adapted for a close conforming fit over at least a front portion of the fuel dispensing nozzle;

(d) said boot having integrally surmounted thereon, a housing;

(e) said housing containing therein, a signal recording and playback system.

3. A fuel dispensing nozzle as claimed in claim 2 wherein the recording and playback system is a high density integrated circuit analog signal system.

4. A fuel dispensing nozzle comprising:

(a) a spout;

(b) a handle for the spout;

(c) a flexible boot adapted for a close conforming fit over at least a front portion of the fuel dispensing nozzle;

(d) said boot having integrally surmounted thereon, a housing;

(e) said housing containing therein, a signal recording and playback system;

(f) said signal recording and playback system having electrically linked thereto a switch for activating and deactivating said signal recording and playback system.

5. A fuel dispensing nozzle as claimed in claim 4, wherein the switch (f) is located on the handle for the nozzle.

6. A fuel dispensing nozzle as claimed in claim 4, wherein the switch (f) is located in the housing.

7. A method of providing a pre-recorded message during the fueling of a vehicle having a fuel port, said method comprising:

utilizing a fuel dispensing device which is equipped with a fuel dispensing nozzle comprising:

(a) a spout;

(b) a handle for the spout;

(c) a flexible boot adapted for a close conforming fit over at least a front portion of the fuel dispensing nozzle, said boot having integrally surmounted thereon, (d) a housing;

(e) said housing containing therein, a signal recording and playback system;

(f) said signal recording and playback system having electrically linked thereto a switch for activating and deactivating said signal recording and playback system;

which fuel dispensing device is in a deactivated position at the beginning of the fueling;

removing said nozzle from the deactivated position;

placing the nozzle in said fueling port, whereby the switch is activated, which activates the signal record and playback system into a playback mode, whereby a pre-recorded message is rendered audible for the duration of the fueling of the vehicle.

* * * * *